US005243828A

United States Patent [19]

Paige et al.

[11] Patent Number: 5,243,828

[45] Date of Patent: Sep. 14, 1993

[54] CONTROL SYSTEM FOR COMPRESSOR PROTECTION IN A MANUALLY OPERATED REFRIGERANT RECOVERY APPARATUS

[75] Inventors: Lowell E. Paige, Pennellville; Richard J. Duell, Syracuse, both of N.Y.

[73] Assignee: Carrier Corporation, Syracuse, N.Y.

[21] Appl. No.: 997,000

[22] Filed: Dec. 28, 1992

[51] Int. Cl.[5] ..... F25B 49/00

[52] U.S. Cl. ..... 62/125; 62/292; 62/149

[58] Field of Search ..... 62/77, 149, 213, 228.3, 62/292, 126, 125, 129

[56] References Cited

U.S. PATENT DOCUMENTS 5,181,390 1/1993 Cavanaugh et al. ..... 62/126

FOREIGN PATENT DOCUMENTS 2169972 6/1990 Japan ..... 62/149

*Primary Examiner*—John M. Sollecito

[57] ABSTRACT

A system for recovering compressible refrigerant from a refrigeration system, of the type having a compressor for lowering the pressure in the refrigeration system to effect the withdrawal of the refrigerant therefrom, and directing the refrigerant to a storage cylinder. The system is operable in a storage cylinder cooling mode of operation wherein the temperature and pressure of the refrigerant withdrawn from the system and stored in the cylinder is lowered. A control system for limiting the pressure ratio across the compressor during operation of the recovery system is provided. The control system includes first means for determining the suction pressure of the compressor and for terminating operation of the recovery system when a desired termination pressure is reached. A second means is provided for determining suction pressure of the compressor, and, for interrupting power to the compressor, and generating a signal perceivable to the user of the recovery system when a predetermined suction pressure greater than the termination pressure is reached. Means are provided for determining the discharge pressure of the compressor, and, for selectively placing the first means for determining suction pressure in the circuit of the control system when the discharge pressure is less than a predetermined value, or, for placing the second means for determining suction pressure in the control system when the discharge pressure equals or exceeds the predetermined value.

8 Claims, 4 Drawing Sheets

| SWITCH POSITION | SWITCH CONNECTIONS | | | | | | |
|---|---|---|---|---|---|---|---|
| | L1* | 2 | 3 | 4 | 5 | T | S* |
| LIQUID RECOVERY | X | X | X | | | X | X |
| VAPOR RECOVERY | X | | | X | X | X | X |
| TANK COOL | X | | X | | | X | X |
| SERVICE | | X | X | X | X | | X |

*-POWER SOURCES

| MODE | COMPONENT | | | | |
|---|---|---|---|---|---|
| | SV-2 | SV-3 | SV-4 | SV-5 | COMPRESSOR COND. FAN |
| LIQUID RECOVERY | OP | OP | CL | CL<br>OP* | ON |
| VAPOR RECOVERY | CL | CL | OP | OP | ON |
| TANK COOL | CL | OP | CL | CL<br>OP* | ON |
| SERVICE | OP | OP | OP | OP | OFF |

FIG.5

| REF. DESIG. | NOMENCLATURE | TYPE | FUNCTION |
|---|---|---|---|
| HPS | HIGH-PRESSURE SWITCH | SPST | OPENS @ 426 psig |
| | | | RESETS @ 320 psig |
| LPS-1 | LOW-PRESSURE SWITCH #1 | SPST | OPENS @ 10" Hg VACUUM |
| | | | RESETS @ 15 psig |
| LPS-2 | LOW-PRESSURE SWITCH #2 | SPST | OPENS @ 0 psig |
| | | | RESETS @ 25 psig |
| DPS | DISCHARGE PRESSURE SWITCH | SPDT | 1-3 POSITION WHEN PRESSURE < 150 psig |
| | | | 1-2 POSITION WHEN PRESSURE ≥ 150 psig |

FIG.6

CONTROL SYSTEM FOR COMPRESSOR PROTECTION IN A MANUALLY OPERATED REFRIGERANT RECOVERY APPARATUS

BACKGROUND OF THE INVENTION

1. Field of the Invention

This invention relates to refrigerant recovery systems. More specifically, it relates to an arrangement for recovery of refrigerant from a refrigeration system wherein all controls and mode switching are done manually by the operator.

2. Description of the Prior Art

A wide variety of mechanical refrigeration systems are currently in use in a wide variety of applications. These applications include domestic refrigeration, commercial refrigeration, air conditioning, dehumidifying, food freezing, cooling and manufacturing processes, and numerous other applications. The vast majority of mechanical refrigeration systems operate according to similar, well known principals, employing a closed-loop fluid circuit through which a refrigerant flows. A number of saturated fluorocarbon compounds and azeotropes are commonly used as refrigerants in refrigeration systems. Representative of these refrigerants are R-12, R-22, R-500 and R-502.

Those familiar with mechanical refrigeration systems will recognize that such systems periodically require service. Such service may include removal, of, and replacement or repair of, a component of the system. Further during normal system operation the refrigerant can become contaminated by foreign matter within the refrigeration circuit, or by excess moisture in the system. The presence of excess moisture can cause ice formation in the expansion valves and capillary tubes, corrosion of metal, copper plating and chemical damage to insulation in hermetic compressors. Acid can be present due to motor burn out which is caused by overheating of the refrigerant. Such burn outs can be temporary or localized in nature as in the case of a friction producing chip which produces a local hot spot which overheats the refrigerant. The main acid of concern is HCL but other acids and contaminants can be produced as the decomposition products of oil, insulation, varnish, gaskets and adhesives. Such contamination may lead to component failure or it may be desirable to change the refrigerant to improve the operating efficiency of the system.

When servicing a refrigeration system it has been the practice for the refrigerant to be vented into the atmosphere, before the apparatus is serviced and repaired. The circuit is then evacuated by a vacuum pump, which vents additional refrigerant to the atmosphere, and recharged with new refrigerant. This procedure has now become unacceptable for environmental reasons, specifically, it is believed that the release of such fluorocarbons depletes the concentration of ozone in the atmosphere. This depletion of the ozone layer is believed to adversely impact the environment and human health. Further, the cost of refrigerant is now becoming an important factor with respect to service cost, and such a waste of refrigerant, which could be recovered, purified and reused, is no longer acceptable.

To avoid release of fluorocarbons into the atmosphere, devices have been provided that are designed to recover the refrigerant from refrigeration systems. The devices often include means for processing the refrigerants so recovered so that the refrigerant may be reused.

Representative examples of such devices are shown in the following U.S. Pat. Nos. 4,441,330 "Refrigerant Recovery And Recharging System" to Lower et al; 4,476,688 "Refrigerant Recovery And Purification System" to Goddard; 4,766,733 "Refrigerant Reclamation And Charging Unit" to Scuderi; 4,809,520 "Refrigerant Recovery And Purification System" to Manz et al; 4,862,699 "Method And Apparatus For Recovering, Purifying and Separating Refrigerant From Its Lubricant" to Lounis; 4,903,499 "Refrigerant Recovery System" to Merritt; and 4,942,741 "Refrigerant Recovery Device" to Hancock et al.

When most such systems are operating, a recovery compressor is used to withdraw the refrigerant from the unit being serviced. As the pressure in the service unit is drawn down, the pressure differential across the recovery compressor increases because the pressure on the suction side of the compressor becomes increasingly lower while the pressure on the discharge side of the compressor stays constant. High compressor pressure differentials can be destructive to compressor internal components because of the unacceptably high internal compressor temperatures which accompany them and the increased stresses on compressor bearing surfaces. Limitations on the pressure differentials or pressure ratio across the recovery compressors are thus necessary, such limitations, in turn can limit the percentage of the total charge of refrigerant contained within the unit being serviced that may be successfully recovered.

When using such recovery systems in servicing larger refrigeration systems it is particularly advantageous to have the capability of withdrawing refrigerant from the system in the liquid form and delivering it directly to a storage cylinder. The recovery of the refrigerant in liquid form, because of its much greater density, is obviously far quicker than recovery in the vapor state.

Commonly assigned U.S. application Ser. No. 07/612,642 entitled METHOD AND APPARATUS FOR RECOVERING AND PURIFYING REFRIGERANT INCLUDING LIQUID RECOVERY was filed on Nov. 13, 1990. This Application discloses a microprocessor controlled apparatus capable of both recovering and purifying refrigerant. The disclosed device is capable of withdrawing refrigerant in a liquid state directly from a refrigeration system being serviced and delivering the refrigerant to a storage cylinder. This system is also capable of cooling the refrigerant storage cylinder during the liquid recovery mode to lower the pressure and temperature of the storage cylinder below ambient temperature. The system is capable of automatically shifting from a liquid recovery mode to a vapor recovery mode when predetermined conditions in the recovery system are measured.

Commonly assigned U.S. application Ser. No. 07/816,002 entitled Manually Operated Refrigerant Recovery Apparatus was filed on Jan. 2, 1992 now U.S. Pat. No. 5,181,390. This application discloses a manually controlled refrigerant recovery apparatus. The system allows the manual control of the recovery apparatus to allow refrigerant withdrawn from a refrigeration system and transferred to a storage cylinder to be cooled to lower the pressure and temperature of the storage cylinder below ambient temperature. The apparatus indicates to an operator when to manually take the steps necessary to shift from a liquid recovery mode to a vapor recovery mode.

Operation of the system of this application requires a relatively high level of skill of the operator in order to operate the proper manually operated switches and valves in order to effect the desired evacuation of the refrigeration system being serviced.

Further, the control system of that application does not afford protection to the recovery systems compressor that is provided by the pressure ratio sensing capability of the microprocessor of the above identified application Ser. No. 07/612,642.

SUMMARY OF THE INVENTION

A system for recovering compressible refrigerant from a refrigeration system, of the type having a compressor for lowering the pressure in the refrigeration system to effect the withdrawal of the refrigerant therefrom, and directing the refrigerant to a storage cylinder. The system is operable in a storage cylinder cooling mode of operation wherein the temperature and pressure of the refrigerant withdrawn from the system and stored in the cylinder is lowered. A control system for limiting the pressure ratio across the compressor during operation of the recovery system is provided. The control system includes first means for determining the suction pressure of the compressor and for terminating operation of the recovery system when a desired termination pressure is reached. A second means is provided for determining suction pressure of the compressor, and, for interrupting power to the compressor, and generating a signal perceivable to the user of the recovery system when a predetermined suction pressure greater than the termination pressure is reached. Means are provided for determining the discharge pressure of the compressor, and, for selectively placing the first means for determining suction pressure in the circuit of the control system when the discharge pressure is less than a predetermined value, or, for placing the second means for determining suction pressure in the control system when the discharge pressure equals or exceeds the predetermined value.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiment when read in connection with the accompanying drawings wherein:

FIG. 5 is a chart showing the operation of the various components of a system according to the present invention during different modes of system operation; and FIG. 6 is a chart summarizing the operating characteristics of the pressure switches used in the, apparatus of FIG. 1.

DESCRIPTION OF THE PREFERRED EMBODIMENT

Figure 1:
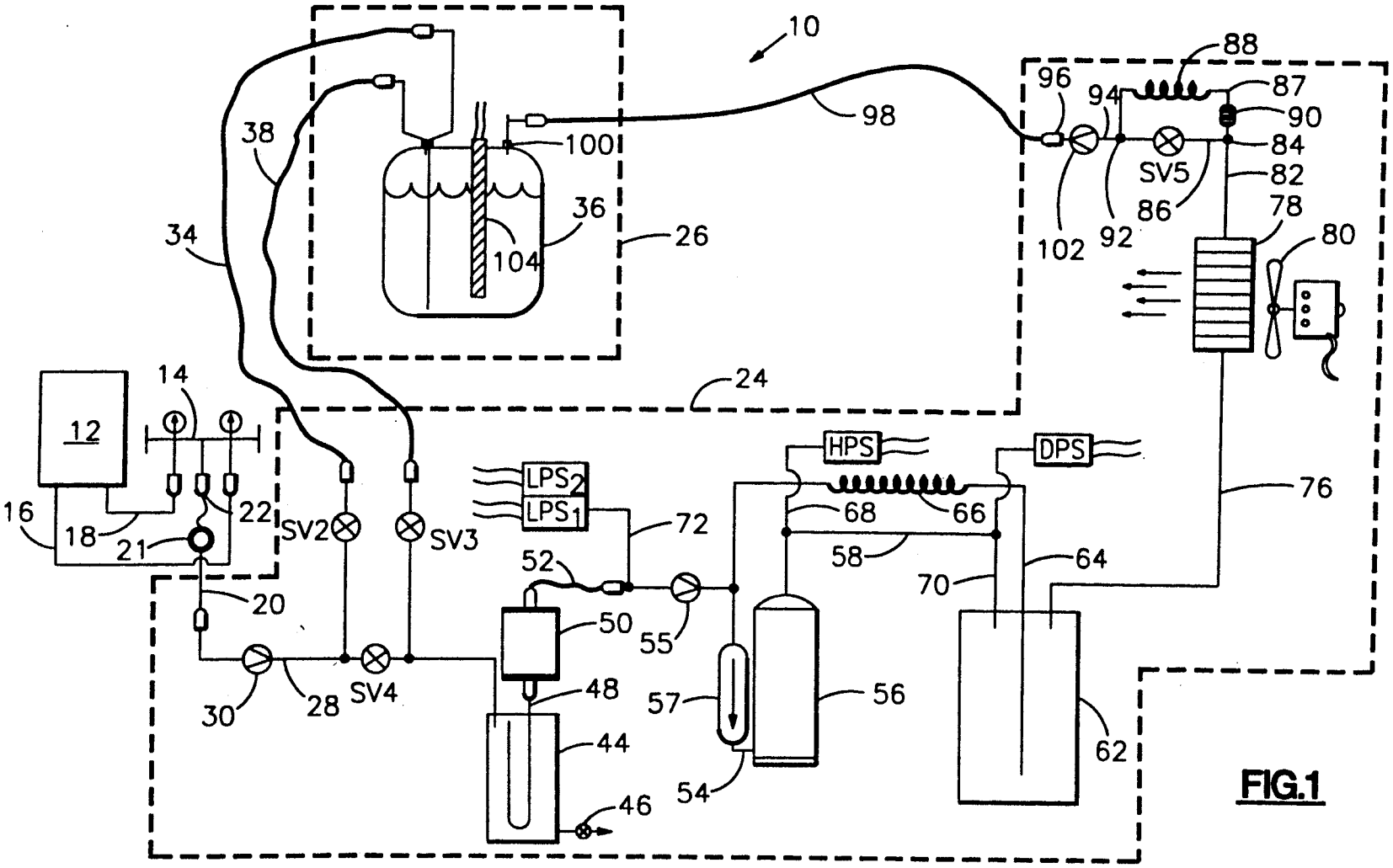
FIG. 1 is a diagrammatical representation of a refrigerant recovery apparatus embodying the principals of the present invention.

An apparatus for recovering refrigerant from a refrigeration system is generally shown at reference numeral 10 in FIG. 1. The refrigeration system to be evacuated is generally indicated at 12 and may be virtually any mechanical refrigeration system.

As shown, the interface between the recovery system 10 and the system being serviced 12 is a standard gauge and service manifold 14. The manifold 14 is connected to the refrigeration system to be serviced in a standard manner with one line 16 connected to the low pressure side of the system and another line 18 connected to the high pressure side of the system. A flexible high pressure refrigerant line 20 is interconnected between the service connection 22 of the service manifold and an appropriate coupling 23 forming a part of the recovery unit 10. A sight glass 21 is provided in the refrigerant recovery line 20.

The recovery system 10 includes two sections, as shown in FIG. 1, the components and controls of the recovery system are contained within a self-contained compact housing (not shown) schematically represented by the dotted line 24. A refrigerant storage section of the system is contained within the confines of the dotted lines 26. The details of each of these sections and their interconnection and interaction with one another will now be described in detail.

From the coupling 23, a refrigerant line 28 extends to the inlet of a combination accumulator/oil trap 44, having an oil drain spigot 46. The refrigerant line 28 includes check valve 30 which prevents back flow of refrigerant from the recovery system to the system being serviced, and downstream therefrom electrically actuated solenoid valve identified as SV4. The valve SV4, as well as additional electrically actuated solenoid valves in the system to selectively allow refrigerant to pass there through when actuated to its open position or will prevent the flow of refrigerant there through when electrically actuated to its close position.

Upstream from the solenoid valve SV4 a refrigerant line 34 connects line 28 directly to the refrigerant storage section of the system where it communicates with the refrigerant storage cylinder 36. An electrically actuated solenoid valve SV2 is located in the refrigerant line 34. Downstream from the solenoid valve SV4 a second refrigerant line 38 interconnects refrigerant line 28 with the refrigerant storage cylinder 36. This line also has an electrically actuated solenoid valve SV3 positioned therein.

Looking now at the rest of the recovery circuit the accumulator/oil trap 44 is connected via conduit 48 to an acid purification filter-dryer 50 where impurities such as acid, moisture, foreign particles and the like are removed before refrigerant is conducted via conduit 52 to the suction port 54 of a compressor 56. A suction line accumulator 57 is disposed in the conduit 52 to assure that no liquid refrigerant passes to the suction port 54 of the compressor. The compressor 56 is preferably of the rotary type, which are readily commercially available from a number of compressor manufacturers, but may be of any type such as reciprocating, scroll or screw. The conduit 52 also includes a check valve 55 which allows flow only in the direction from the filter-dryer 50 to the compressor.

A refrigerant line 58 establishes fluid communication between the compressor discharge port and an oil separator 62. In the oil separator 62 any recovery system compressor lubricating oil entrained in the compressor discharge gas is removed and returned to the compressor via return line 64, having a capillary tube 66 disposed therein and back to the compressor suction line. The capillary tube 66 is sized to allow sufficient oil return but is also restrictive enough to limit the by-pass of high pressure refrigerant vapor back to the compressor suction where oil is not present in the separator.

The outlet of the oil separator 62 is interconnected via conduit 76 to the inlet of a heat exchanger/condenser coil 78. An electrically actuated condenser fan 80 is associated with the coil 78 to direct the flow of ambient air across the coil as will be described in connection with operation of the system.

From the outlet of the condenser coil 78 an appropriate conduit 82 conducts refrigerant to a T-connection 84. From the T-84, one conduit 86 passes to another electrically actuated solenoid valve SV5, while the other branch 87 of the T passes to a suitable refrigerant expansion device 88. In the illustrated embodiment, the expansion device 88 is a capillary tube and a strainer 90 is disposed in the refrigerant line 87 upstream from the capillary tube to remove any particles which might potentially block the capillary. It should be appreciated that the expansion device could comprise any of the other numerous well known refrigerant expansion devices which are widely commercially available. The conduit 87, containing the expansion device 88, and the conduit 86, containing the valve SV5, rejoin at a second T-connection 92 downstream from both devices. It should be appreciated that the solenoid valve SV5 and the expansion device 88 are in a parallel fluid flow relationship. As a result, when the solenoid valve SV5 is open, the flow of refrigerant will be, because of the high resistance of the expansion device, through the solenoid valve in a substantially unrestricted manner. On the other hand, when the valve SV5 is closed, the flow of refrigerant will be through the high resistance path provided by the expansion device.

From the second T-92, a conduit 94 passes to an appropriate coupling 96 for connection of the system as defined by the confines of the line 24, via a flexible refrigerant line 98 to another inlet port 100 of the previously referred to refrigerant storage container 36. A check valve 102 is disposed in the refrigerant line 94 which allows refrigerant to flow only in the direction from second T-92 in the direction of the refrigerant storage cylinder 36.

The refrigerant storage cylinder 36 further includes a liquid level indicator 104. The liquid level indicator, for example, may comprise a compact continuous liquid level sensor of a type available form Imo Delaval Inc., Gems Sensors Division. Such an indicator is capable of providing an electrical signal indicative of the level of the refrigerant contained within the storage cylinder 36. This signal may be used to terminate a refrigerant recovery operation in order to avoid over filling of the refrigerant storage cylinder 36.

Four pressure switches are provided in the recovery system which are in electrical connection with the low voltage control circuit of the system as will be described in detail below. These switches include the high pressure switch "HPS," and the discharge pressure switch "DPS" which are interconnected, via conduits 68 and 70 respectively to the discharge side of the compressor 56. A pair of low pressure switches "LPS-1 and LPS-2" are operatively connected via conduit 72 to the suction side of the compressor 56.

Figure 2:
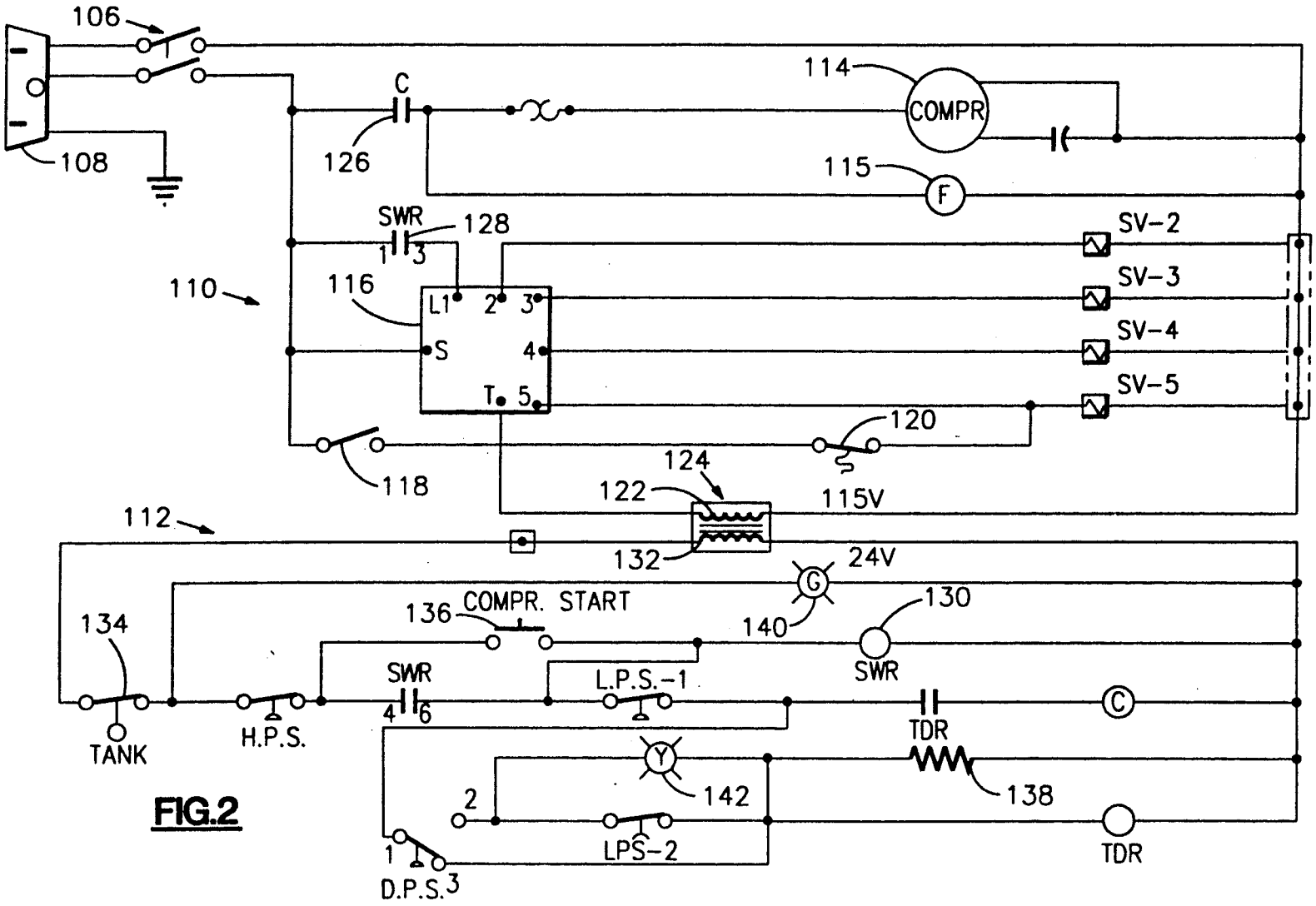
FIG. 2 is an electrical control wiring diagram for the apparatus of FIG. 1.
Figures 3, 4:
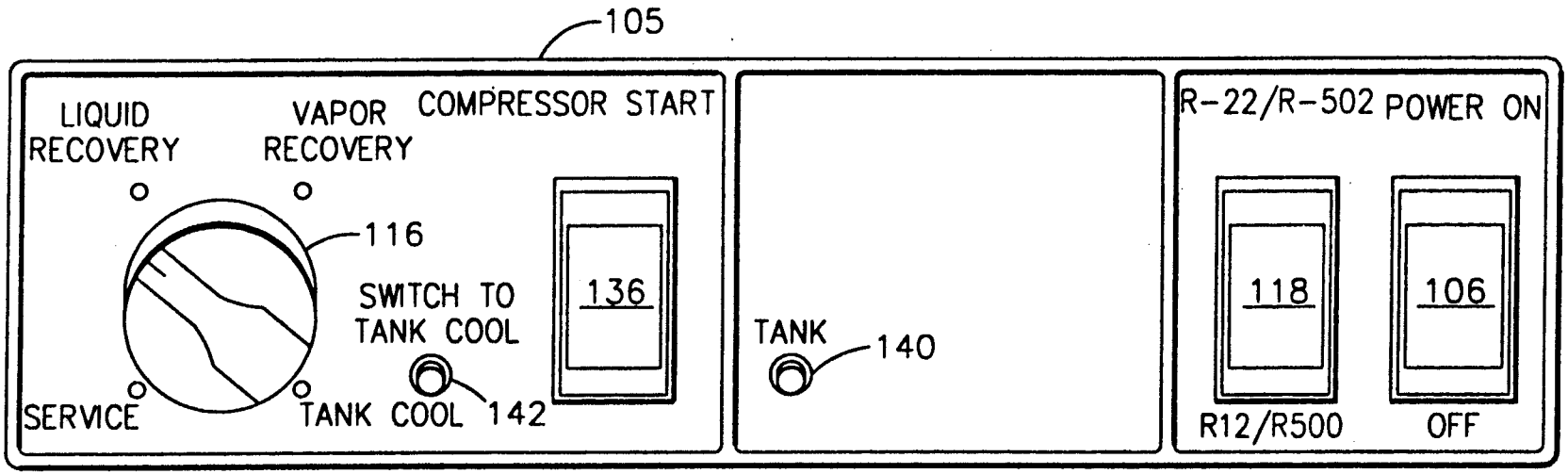
FIG. 3 illustrates the layout of the control console of the apparatus of FIG. 1.
FIG. 4 is a mode selection switch connection logic diagram for the apparatus of FIG. 1.

FIG. 2 illustrates a schematic electrical control wiring diagram for control of the refrigerant recovery unit 10. This circuit will be described in connection with FIG. 3 which shows the control switch layout on the console 105 of a refrigerant recovery unit incorporating the principals of the present invention. FIGS. 2 and 3 will be described in conjunction with one another and with reference to the components as illustrated in FIG. 1. Reference will also be made to FIGS. 4, 5 and 6 in discussing switch connections, valve conditions and pressure switch characteristics.

Referring now to FIG. 2, primary, 115 volt, single phase power 108 is applied to the refrigerant recovery system electromechanical control system on-off power switch 106. The control system is basically divided into two sections, a line voltage section generally designed at 110 and a low voltage section generally, 112. Components contained in the line voltage section 110 include the previously mentioned on-off switch 106, a compressor motor 114, a fan motor 115, the solenoid valve electrical coils for the four previously identified valves SV2, SV3, SV4 and SV5, and a four position rotary electrical mode selection switch 116. Also, included are a refrigerant type selection switch 118, an ambient temperature switch 120, the primary side 122 of a control transformer 124, a set of normally open contacts 126 in the compressor/fan motor contactor, and, a set of normally open contacts 128 (contacts 1-3 SWR) operated by the switch relay coil 130 which, as will be seen, is located in the low voltage section 112.

Components contained in the low voltage section 112 include the secondary side 132 of the control transformer 124, a set of electrical contacts 134 located in the overfill switch in the refrigerant storage tank 36. The previously referred to high pressure switch HPS and the two low pressure switches LPS-1 and LPS-2 as well as the single pole double throw discharge pressure switch DPS are also contained in the low voltage section. The low voltage section further includes a time delay relay including both coil and contacts both identified as TDR, and the coil of the compressor contactor "C". Finally, the low voltage section includes the previously referenced switch relay coil 130 (SWR) and a set of low voltage normally open contacts associated with that coil (contacts 4-6 SWR), a momentary contact compressor start switch 136, and a load increasing resister 138.

A green indicator light 140 is also included in the low voltage section, this light is physically located on the control console 105 as seen in FIG. 3. A second indicator light 142, which when illuminated is yellow, is also located in the low voltage section and is also physically located on the control console 105.

The refrigerant recovery system 10 may be operated in any of four modes (a)—vapor refrigerant recovery; (b)—liquid refrigerant recovery; (c)—storage cylinder cooling; and (d)—service. In operation the solenoid valves SV-2 through SV-5 determine the refrigerant flow path through the recovery system in the various modes of operation. The opening of the solenoid valves is controlled by actuation of the manually operated rotary mode selection switch 116. The switch 116, located on the console 105 as shown in FIG. 3, has four manually selected positions corresponding to the four modes of operation as described above. With reference now to FIGS. 2 and 4 it will be seen that the switch 116 has seven connections through which individual components of the recovery system are energized depending on the position of the rotary switch 116. Specifically, it will be seen that electric power from the on-off switch 106 enters the rotary switch at two locations, L1 and S. L1 is capable of supplying power to outputs 2, 3, 4 and 5 which outputs are interconnected to the actuating coils of solenoid valves SV-2 through SV-5 respectively. Power input S supplies power to output T which in turn powers the primary 122 of the control transformer 124. FIG. 4 illustrates the inputs and outputs of the rotary switch 116 which are interconnected during the different modes of operation, it should be noted that an "X" in this Figure represents a closed position.

Looking now at the vapor recovery mode, reference to FIG. 4 will show that with the rotary switch 116 in the vapor recovery mode position, line power is provided via L1 and S to solenoid valves SV4 and SV5, and, via output T, to the low voltage section of the control system. When the systems is started (as will be described in connection with the low voltage section 112) power is also directed to the compressor and condenser fan motors 114, 115, as indicated with reference to FIG. 5.

With the system components actuated as described in the vapor recovery mode, vaporous refrigerant, from the system being evacuated 12, is drawn into the recovery system 10 through the service gauge manifold 14, it then passes via service connection 22, through the sight glass 21, refrigerant line 20, check valve 30 and conduit 28 through open solenoid valve SV-4. The vaporous refrigerant then passes from open SV4 into the accumulator oil trap 44 and through the filter dryer 50 to the compressor 56. From the compressor 56 hot compressed refrigerant gas passes to the discharge oil separator 62. In the oil separator 62 any compressor lubricating oil entrained in the compressor discharge gas is removed and returned to the compressor through the return line 64, and the capillary tube 66. From the oil separator 62 refrigerant passes, via line 76, to the air cooled condenser 78 where it is condensed into a liquid state. Exiting from the condenser liquid refrigerant passes via conduit 82 through the open valve SV-5 and conduits 94 and 98 into the storage cylinder 36. During vapor recovery it will be noted that solenoid valves SV2 and SV3 remain closed.

Looking now at the liquid recovery mode of operation reference to FIG. 4 will show that, with the rotary mode selection switch in the liquid recovery position, terminal L1 is powered and provides power to the outputs to terminals 2 and 3 thereby opening solenoid valves SV2 and SV3. Likewise terminal S is powered and provides power to the low voltage section 112. As seen from FIG. 5, the compressor and condenser fan motors 114, 115 are also energized.

In the liquid recovery mode liquid refrigerant enters the refrigerant recovery system from the service gage manifold 14, sight glass 21, conduit 20 and conduit 28. It then passes through open solenoid valve SV2 and conduit 34 directly to the storage cylinder 36.

At the same time, vaporous refrigerant is being withdrawn from the top of the storage cylinder 36 via conduit 38 and open solenoid valve SV-3. This refrigerant passes through the accumulator 44, filter dryer 50 to the compressor 56. Compressed refrigerant exiting from the compressor 56 passes through the discharge oil separator 62 and via conduit 76 to the air cooled condenser 78. Liquid refrigerant passing from the condenser 78 then passes through the capillary tube 88 (SV5 now being closed) where expansion occurs and the temperature and pressure of the refrigerant is lowered. The low temperature low pressure refrigerant then passes via conduits 94 and 98 back into the storage cylinder 36. The above described extraction of vapor from the storage cylinder 36 and the injecting of low temperature refrigerant from the expansion device 88 serves to cool the storage cylinder 36 thereby lowering the internal pressure. As the internal pressure in the storage tank is lowered the pressure differential between the tank and the system from which refrigerant is being extracted 12 is increased thereby encouraging the flow of liquid refrigerant from the system being serviced into the storage cylinder via SV-2 and conduit 34. During such operation the solenoid valves SV4 and SV5 remain closed.

A special exception to the above described liquid recovery mode of operation occurs when higher pressure refrigerants are being recovered at high ambient air temperatures. In connection with this reference is made to FIGS. 2 and 3 where the refrigerant type selection switch 118 is shown. The position of this switch is selected prior to the initiation of a recovery operation and depends upon whether the refrigerant to be recovered is classified as a "high" pressure refrigerant or a "low" pressure refrigerant. For low pressure refrigerants such as R12 and R500 the lower part of the switch 118 is depressed and the contacts of the switch 118 are open. When high pressure refrigerant such as R22 and R502 are being recovered the upper part of switch 118 is depressed and the contacts 118 are closed. Under these conditions if the ambient air temperature rises above 90° F. the ambient temperature switch 120 will close and power will be directed to the solenoid valve SV5 and it will be open. With the solenoid valve SV5 opened this valve, as well as the capillary tube expansion device 88 will both act as expansion devices to facilitate the above described cooling of the storage cylinder 36 at the high ambient temperature high pressure refrigerant conditions.

Operation of the recovery apparatus in the storage cylinder cooling mode is identical to that in the liquid recovery mode except that solenoid valve SV2 in refrigerant line 34 is closed. Operation of the system in the storage cylinder cooling mode is carried out in the vapor recovery mode to prevent excessive pressure ratios across the recovery system compressor 56, which could impose unacceptable conditions on the compressor and eventually compromise compressor reliability. Following a storage cylinder cooling cycle, the refrigerant storage cylinder 36 replaces the air cooled condenser 78 as the condenser in the system, thus lowering the compressor discharge pressure and reducing the compressor pressure ratio. The operation of the control system to achieve such protection will now be described in greater detail. Before proceeding, with reference to FIGS. 2, 4 and 6, it should be noted that in the service mode of operation all solenoid valves are open. This mode is used when performing service operations on the refrigerant recovery unit.

It will be further noted that output terminal "T" is not energized during the service mode and therefore the control transformer 124 is unpowered, this prevents the compressor from being started during the service mode of operation.

As previously briefly described various pressure switches are located in the low voltage control circuit 112. FIG. 6 provides a summary of the operating characteristic of these switches. What follows will elaborate somewhat on the information contained in FIG. 6 in a summary fashion. A more detailed description of the operation of the low voltage control circuit 112 will follow this summary.

The high pressure switch "HPS" is located in the power supply to the low voltage circuit 112 and functions as a high pressure safety shutoff. As is seen from FIGS. 2 and 6 it is a single pole single throw type switch designed to open at 426 PSIG compressor discharge pressure and it will reset automatically when pressure has dropped to a safe value, i.e. at 320 PSIG.

LPS-1 is a single pole single throw pressure switch which is used to shutdown the compressor 56 when compressor suction pressure reaches 10" H.G. vacuum. This condition will occur at the end of a vapor recovery cycle when recovery operation has been completed. It will be noted from FIG. 6 that it resets when compressor suction pressure reaches 15 PSIG.

LPS-2 is a single pole single throw pressure switch which is used to stop a vapor recovery operation when the compressor pressure ratio exceeds 16 to 1. When this switch opens, "i.e. at 0 PSIG" the yellow "switch to tank cool" light 142 on the console 105 will be illuminated. When this light is illuminated the operator of the system is directed to select the "tank cool" mode of operation. After operating in the tank cool mode for a predetermined period of time, e.g. 15 minutes, the system may be returned to the vapor recovery mode of operation. LPS-2 works in conjunction with the discharge pressure switch "DPS" as described below.

Again with reference to FIG. 2 and FIG. 6 DPS comprises a single pole double throw switch. When compressor discharge pressure is less than 150 PSIG the DPS is in the 1-3 position shown in FIG. 2. LPS-1 is then in the control circuit, and controls operations, with LPS-2 being by-passed.

When compressor discharge pressure is greater than or equal to 150 PSIG, DPS shifts to the 1-2 position shown in FIG. 2. When DPS is in the 1-2 position, LPS-2 is placed into the low voltage control circuit enabling LPS-2 to monitor the need for shifting to the tank cooling mode of operation during a vapor recovery mode, as described above.

Looking now in more detail at the low voltage control circuit 112, it will be appreciated from FIG. 2 that the secondary 132 of the controlled transformer 124 supplies 24 volt AC power to the low voltage control circuit 112. The tank level switch 134 is in the supply line to the circuit and is designed to open and interrupt power to the low voltage control circuit when the storage tank in which it is located is filled to 80 percent of its capacity. When the tank level switch 134 opens it shuts down the compressor and condenser fan motor by de-energizing the compressor/condenser fan motor contactor coil "C" and thus opening the high voltage contacts 126 supplying line voltage to the compressor 114 and condenser 115 fan motors. It should be noted that opening of the tank switch 134, also closes any open solenoid valves by de-energizing the coil 130 of the switch relay. When the switch relay 130 is de-energized, relay contacts "1-3" 128 open and interrupt electric power to the rotary switch 116 that supplies power to the appropriate solenoid valves. It should also be noted that the tank light 140 that is normally lighted when the tank switch is in the closed position, and control power is present, will also be turned off when the tank switch 134 opens, this indicates to the user that the tank has been filled. It should be further noted that the tank light 140 will also be turned off when no storage cylinder 36 has been connected to the system.

The compressor start switch 136 is a momentary contact switch which is used in conjunction with the switch relay 130 to start the system and to keep both the rotary switch 116 and the remainder of the low voltage control circuit 112 powered after the compressor start switch 136 is released. More specifically, when the compressor start switch 136 is depressed it allows electric power to be supplied to the coil 130 of the switch relay. When the coil 130 is energized it closes relay contacts "1-3" 128 in the high voltage section 110 which supplies power to the rotary switch 116 to thereby energize the appropriate solenoid valves. At the same time switch relay coil 130 closes relay contacts "4-6" identified as SWR in the low voltage circuit which supplies power to the remainder of the low voltage control circuit 112. It should be noted that once contacts 4-6 are closed the compressor start switch 136 may be released and a circuit is made through 4-6 to act as a holding circuit to keep the coil 130 of the switch relay energized.

The previously reference Time Delay Relay including the, coil and contacts in the voltage circuit 112 is designed to delay the start of the compressor 114 and condenser 115 fan motors for 15 seconds at start up, and, to delay the shutdown of these devices for 3 seconds at termination. The start up delay allows pressure equalization across the compressor at start up to facilitate the ease of compressor starting. The shutdown delay keeps the compressor running during short term power losses such as during rotary mode switch changes or switches of the discharge pressure switch DPS. The resistor 138 is used to increase the current draw through the control circuit 112 to assure contact wetting in the various pressure switches.

As indicated above when the compressor discharge pressure is less than 150 PSI contacts 1-3 of the discharge pressure switch DPS are closed the system operates in a recovery mode until shutdown by the low pressure switch LPS-1. However, when the discharge pressure is greater than 150 PSI the discharge pressure switch contacts 1-2 are closed and the low pressure switch LPS-2 which is designed to limit the pressure differential across the compressor to less than 16-1 is in the circuit. LPS-2, as previously indicated, opens when the compressor suction pressure reaches 0 PSIG. At that time the unit will shutdown and the tank cool light 142 will be illuminated.

At this time the operator is directed to switch the rotary mode selection switch 116 to the tank cool position and the unit will restart in the above described tank cool mode. The operator is instructed to operate the unit in the tank cool mode for 15 minutes, during this time the storage tank 36 and the refrigerant contained within it are cooled to a temperature of as much as 70° F. below ambient temperature. At the end of the 15 minutes tank cool cycle the operator is instructed to move the rotary switch 116 back to the vapor recovery position. During this mode switch the compressor and condenser fan motors will continue to operate as a result of the action of the time delay relay.

After the switch back to the vapor recovery mode the storage tank 36 which was cooled during the tank cool process becomes the recovery systems condenser. Due to its low temperature, the compressor discharge pressure will have dropped to a low level (i.e. less than 150 PSIG) allowing the discharge pressure switch DPS to switch back to the 1–3 position thereby by-passing LPS-2. At this time the recovery system will continue to operate until LPS-1 opens and shuts the unit off when 10" of H.G. vacuum is reached, this indicates the completion of the recovery operation.

It should be appreciated that as a result of such operation the described system is capable of recovering an extremely high percentage of the refrigerant from the system being serviced while at the same time assuring that dangerous compressor pressure ratios are not reached. This goal is achieved with a manually operated system wherein the control system of the recovery unit prompts the operator to make the necessary mode switches which in turn allows such a high efficiency recovery operation to be performed.

What is claimed is:

1. A system for recovering compressible refrigerant from a refrigeration system, of the type having a compressor for lowering the pressure in the refrigeration system to effect the withdrawal of refrigerant therefrom, and directing the refrigerant to a storage cylinder, the system being operable in a storage cylinder cooling mode of operation wherein the temperature and pressure of the refrigerant withdrawn from the system and stored in the cylinder is lowered, comprising:

a control system for limiting the pressure ratio across the compressor during operation of the recovery system including;

first means for determining the suction pressure of said compressor, and, for terminating operation of the recovery system when a desired termination pressure is reached;

second means for determining the suction pressure of said compressor, and, for interrupting power to said compressor, and generating a signal perceivable to the user of the recovery system when a predetermined suction pressure greater than said termination pressure is reached;

means for determining the discharge pressure of the compressor, and, for selectively placing said first means for determining suction pressure in said control system when the discharge pressure is less than a predetermined value; or, for placing said second means for determining suction pressure in the control system when the discharge pressure equals or exceeds said predetermined value.

2. The apparatus of claim 1 wherein said desired termination pressure is less than 0 PSIG.

3. The apparatus of claim 2 wherein said desired termination pressure is 10" Hg vacuum.

4. The apparatus of claim 1 wherein said predetermined suction pressure greater than said termination pressure is in the range between 5" Hg vacuum and 5 PSIG.

5. The apparatus of claim 1 wherein said desired termination pressure is 10" Hg vacuum, and wherein said predetermined suction pressure greater than said termination pressure is 0 PSIG.

6. The apparatus of claim 2 wherein said predetermined value of the discharge pressure is in the range of 140 PSIG to 160 PSIG.

7. The apparatus of claim 1 wherein said desired termination pressure is 10" Hg vacuum, said predetermined suction pressure greater than said termination pressure is 0 PSIG, and wherein said predetermined value of said discharge pressure is 150 PSIG.

8. The apparatus of claim 1 wherein said signal perceivable to the user comprises an indicator light visibly perceived by the user.

* * * * *